US007824195B1

(12) United States Patent
Yu et al.

(10) Patent No.: US 7,824,195 B1
(45) Date of Patent: Nov. 2, 2010

(54) DUAL-MODE ELECTRICAL PLUG

(75) Inventors: Liang Yu, Taipei Hsien (TW); Chia-Ching Lee, Taipei Hsien (TW)

(73) Assignee: Wistron Corporation, Hsichih, Taipei Hsien (TW)

( * ) Notice: Subject to any disclaimer, the term of this patent is extended or adjusted under 35 U.S.C. 154(b) by 0 days.

(21) Appl. No.: 12/695,544

(22) Filed: Jan. 28, 2010

(30) Foreign Application Priority Data

Oct. 20, 2009 (TW) ..... 98219325

(51) Int. Cl.
*H01R 4/66* (2006.01)

(52) U.S. Cl. ..... 439/103; 439/106

(58) Field of Classification Search ..... 439/103, 439/106, 104, 171, 172
See application file for complete search history.

(56) References Cited

U.S. PATENT DOCUMENTS 3,685,000 A * 8/1972 Robbins ..... 439/103
3,890,030 A * 6/1975 McDaniel ..... 439/490
3,914,565 A * 10/1975 Niedermeyer ..... 200/51.09
7,513,782 B1 * 4/2009 Sheldon et al. ..... 439/106

* cited by examiner

*Primary Examiner*—Khiem Nguyen
(74) *Attorney, Agent, or Firm*—Osha • Liang LLP

(57) ABSTRACT

A dual-mode electrical plug includes an insulating body formed with a channel and an elongate guiding aperture; a pair of conductive components disposed on the insulating body; a ground prong including a hollow prong body disposed in the channel and movable between an extended position and a retracted position, and the prong body defining a wire containing space, the ground prong further including an operating part disposed on an outer surface of the prong body, the operating part extending through and being movable in the elongate guiding aperture so as to drive movement of the prong body; and a ground wire extending into the wire containing space and including a connecting end for connecting electrically to an inner surface of the prong body.

6 Claims, 4 Drawing Sheets

DUAL-MODE ELECTRICAL PLUG

CROSS-REFERENCE TO RELATED APPLICATION

This application claims priority of Taiwanese application no. 098219325, filed on Oct. 20, 2009.

BACKGROUND OF THE INVENTION

1. Field of the Invention

This invention relates to a dual-mode electrical plug, more particularly to dual-mode electrical plug having a ground prong that is movable between an extended position and a retracted position.

2. Description of the Related Art

FIGS. 1,2 and 3 illustrate a dual-mode electrical plug of ROC Patent Publication Number 200618417. The dual-mode electrical plug comprises an insulating body 11, a pair of conductive components 12 disposed on the insulating body 11, a ground prong 13 disposed movably in the insulating body 11, a conductive ring 14 and an operating part 15. The conductive ring 14 reinforces an aperture 111 disposed at a front end of the insulating body 11, is sleeved on the ground prong 13, and contacts an outer surface of the ground prong 13 so as to connect electrically the ground prong 13 to a ground wire 16 that is coupled to a rear portion of the conductive ring 14. A sleeving portion 151 of the operating part 15 is sleeved on a rear end of the ground prong 13, and an operating portion 152 of the operating part 15 extends outwardly of the insulating body 11 via a guiding aperture 112 of the insulating body 11. The operating portion 152 is movable in the guiding aperture 112 so as to drive movement of the ground prong 13 between a retracted position (see FIG. 3), in which the ground prong 13 is received in the insulating body 11, and an extended position (see FIG. 2), in which the ground prong 13 extends outwardly of the front end of the insulating body 11 via the aperture 111.

The dual-mode electrical plug of the prior art has the following drawbacks. After a long period of use, friction generated between the conductive ring 14 and the outer surface of the ground prong 13 when the ground prong 13 is moved leads to wearing of the conductive ring 14 and the ground prong 13. Such wear leads to inadequate contact between the ground prong 13 and the conductive ring 14, and consequently, an inadequate electrical connection between the ground prong 13 and ground wire 16. Moreover, structural components of the dual-mode electrical plug are numerous, which incurs increased design and manufacturing costs. Therefore, it is desired to provide a dual-mode electrical plug having a ground prong that maintains an adequate electrical connection with a ground wire, and which can be designed and manufactured at a reduced cost.

SUMMARY OF THE INVENTION

Therefore, an object of the present invention is to provide a dual-mode electrical plug having a ground prong capable of maintaining an adequate electrical connection with a ground wire, and capable of stowing a length of the ground wire in a wire containing space thereof when the ground prong is moved from an extended position to a retracted position.

Another object of the present invention is to provide a dual-mode electrical plug comprising fewer components so as to reduce design and manufacturing costs.

According to the present invention, there is provided a dual-mode electrical plug comprising an insulating body, a pair of conductive components, a ground prong, and a ground wire.

The insulating body is formed with a channel that opens at a front end of the insulating body, and with an elongate guiding aperture disposed along a length of the channel and providing access to the channel from outside of the insulating body.

The conductive components are disposed on the insulating body and extend outwardly of the front end of the insulating body.

The ground prong includes a hollow prong body and an operating part. The prong body is disposed in the channel and is movable in the channel between an extended position, in which the prong body extends outwardly of the front end of the insulating body, and a retracted position, in which the prong body is received in the insulating body. The prong body defines a wire containing space opening toward a rear end of the insulating body. The operating part is disposed on an outer surface of the prong body, extends outwardly of the insulating body through the elongate guiding aperture, and is movable in the elongate guiding aperture so as to drive movement of the prong body between the extended position and the retracted position.

The ground wire extends into the wire containing space and includes a connecting end for connecting electrically to an inner surface of the prong body, a length of the ground wire being stowed in the prong body when the prong body is at the retracted position.

Preferably, the connecting end of the ground wire is connected to the prong body at a front end location of the inner surface of the prong body so as to ensure that the ground wire is smoothly stowed in the wire containing space when the prong body is being moved to the retracted position.

Preferably, the ground prong further includes a protruding part disposed on the outer surface of the prong body, and the insulating body includes a first position limiting part disposed on a channel-defining wall of the channel for engaging the protruding part such that the prong body is retained releasably at the extended position. Therefore, the conductive components and the ground prong of the dual-mode electrical plug can be plugged securely into an electrical outlet having three insertion apertures.

Preferably, the insulating body further includes a second position limiting part disposed on the channel-defining wall behind the first limiting part for engaging the protruding part of the prong body such that the prong body is retained releasably at the retracted position. Therefore, undesired movement of the prong body from the retracted position to the extended position can be avoided.

The merit of the dual-mode electrical plug of the present invention resides in the connecting end of the ground wire being connected to the inner surface of the hollow prong body of the ground prong, which enables the ground wire to maintain an adequate electrical connection with the ground prong so as to achieve effective grounding regardless of whether the prong body is at the extended position or at the retracted position. Moreover, such connection of the ground wire to the prong body allows a length of the ground wire to be smoothly stowed in the wire containing space of the prong body when the prong body is moved from the extended position to the retracted position. Lastly, the dual-mode electrical plug of the present invention comprises relatively few components as compared with the dual-mode electrical plug of the prior art, and thus can be designed and manufactured at reduced costs.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
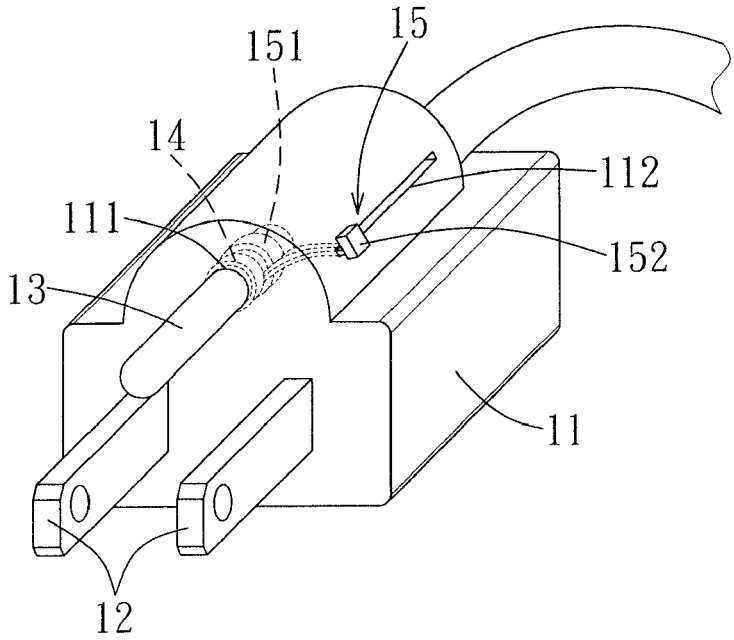
FIG. 1 PRIOR ART
FIG. 1 is a perspective view of a dual-mode electrical plug disclosed in ROC Patent Publication No. 200618417.
Figure 2:
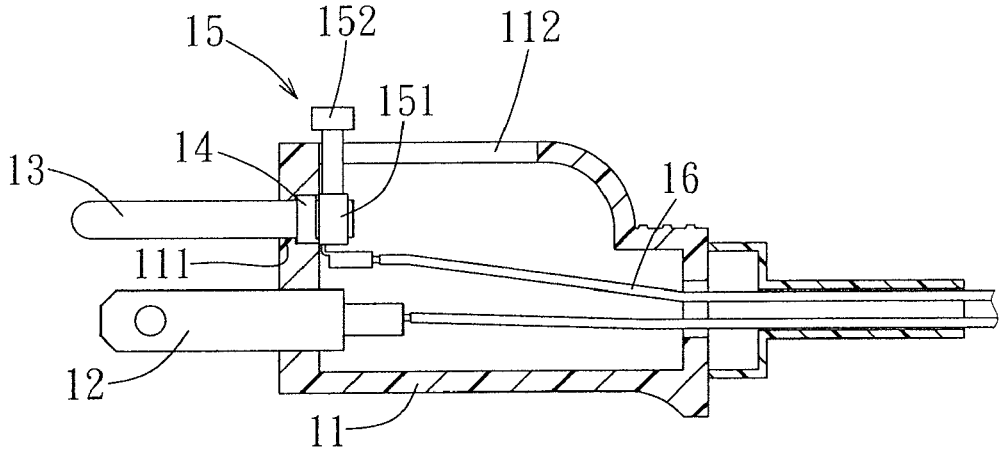
FIG. 2 PRIOR ART
FIG. 2 is a sectional view of the dual-mode electrical plug of ROC Patent Publication No. 200618417, illustrating a ground prong thereof at an extended position.
Figure 3:
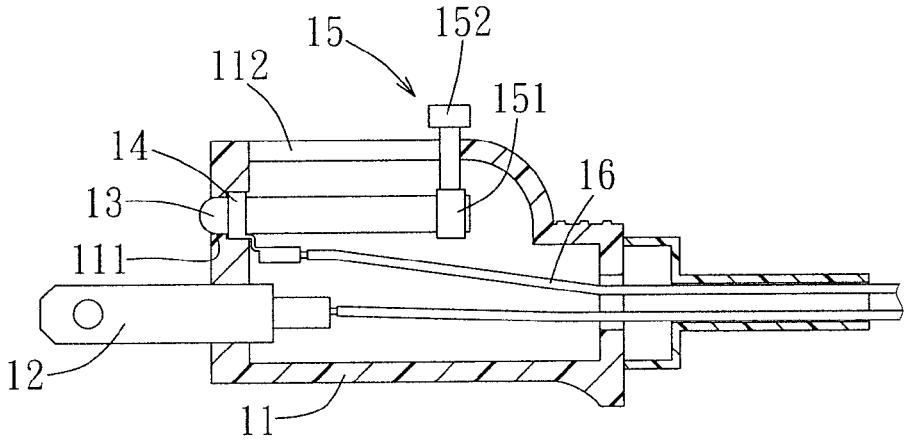
FIG. 3 PRIOR ART
FIG. 3 is a sectional view of the dual-mode electrical plug of ROC Patent Publication No. 200618417, illustrating the ground prong thereof at a retracted position.
Figure 4:
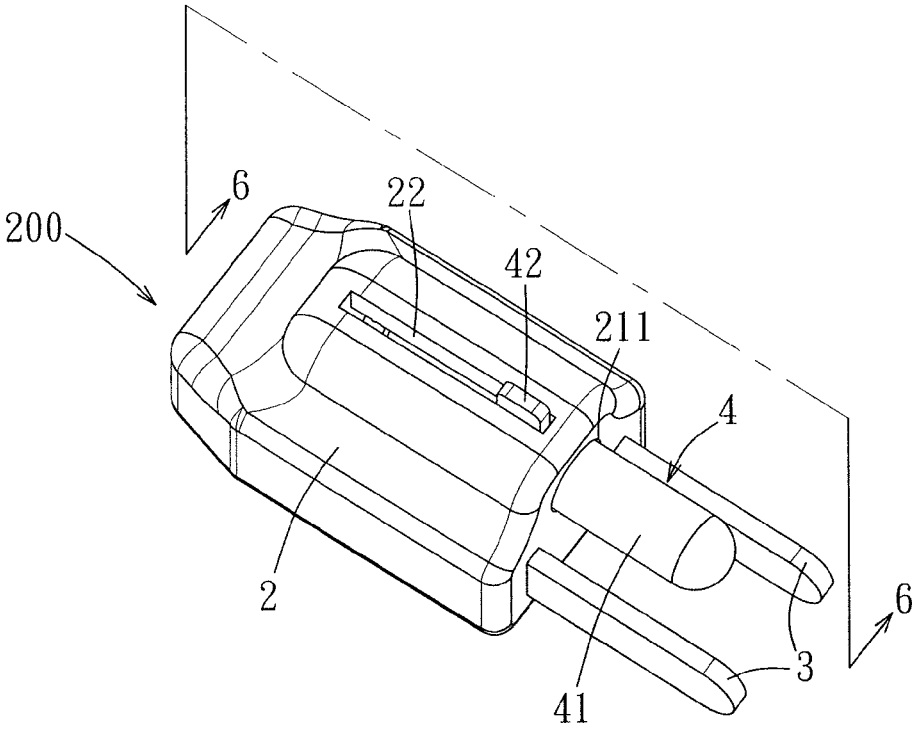
FIG. 4 is a perspective view of a preferred embodiment of a dual-mode electrical plug according to the present invention, illustrating a prong body thereof at an extended position.
Figure 5:
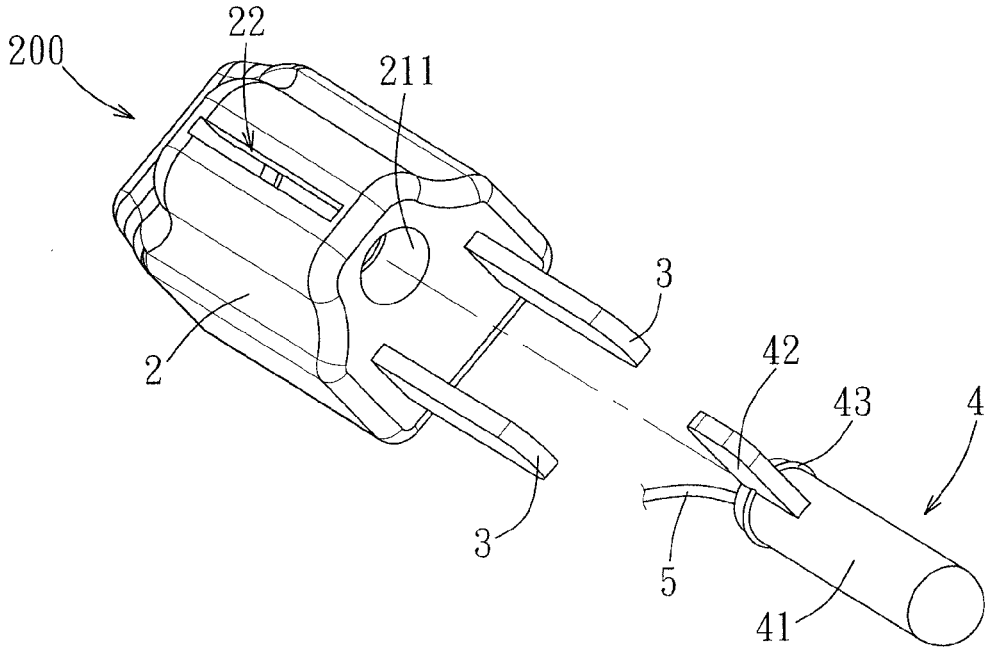
FIG. 5 is an exploded perspective view of the preferred embodiment of the dual-mode electrical plug.

FIGS. 4 and 5 illustrate the preferred embodiment of a dual-mode electrical plug according to the present invention. The dual-mode electrical plug 200 comprises an insulating body 2, a pair of conductive components 3, a ground prong 4 and a ground wire 5. The conductive components 3 are formed from a metal material for conducting power. The ground prong 4 is also formed from a metal material and is used in conjunction with the ground wire 5 for grounding.

Figure 6:
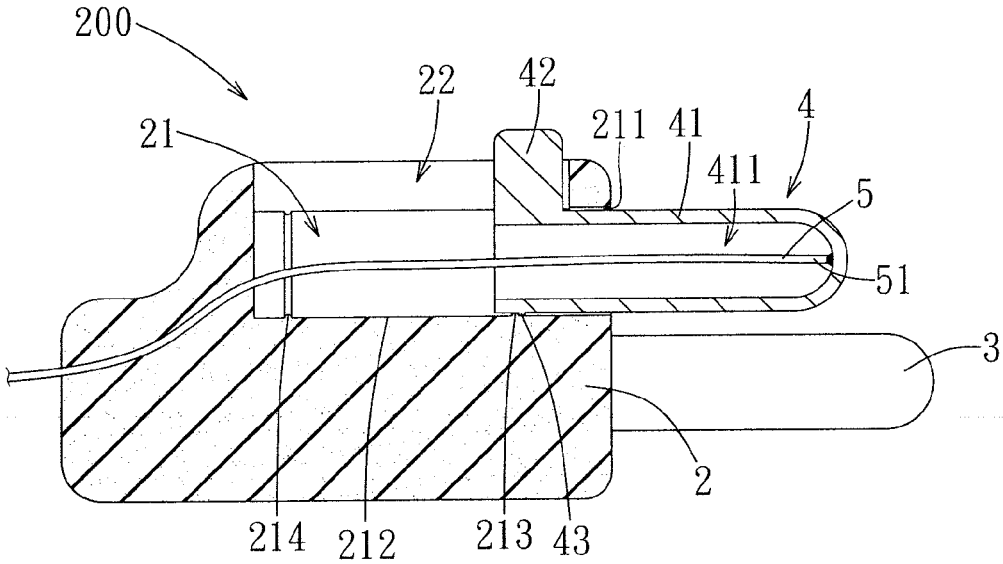
FIG. 6 is a sectional view of the preferred embodiment of the dual-mode electrical plug taken along line 6-6 of FIG. 4, illustrating the prong body thereof at the extended position.

With further reference to FIG. 6, the insulating body 2 is formed with a channel 21 that opens at a front end of the insulating body 2 via an aperture 211, and with an elongate guiding aperture 22 disposed along a length of the channel 21 and providing access to the channel 21 from outside of the insulating body 2.

The conductive components 3 are disposed on the insulating body 2 and extend outwardly of the front end of the insulating body 2.

Figure 8:
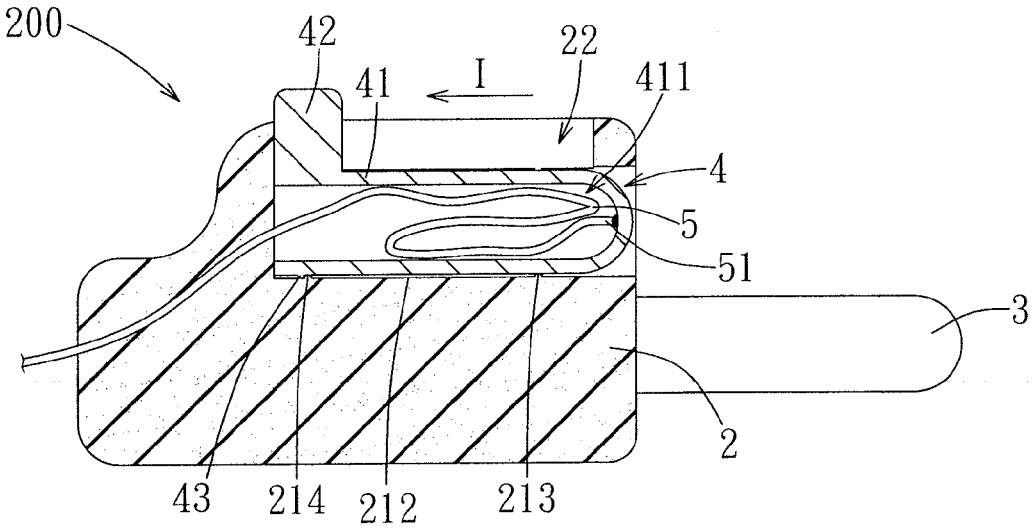
FIG. 8 is a sectional view of the preferred embodiment of the dual-mode electrical plug taken along line 8-8 of FIG. 7, illustrating the prong body thereof at the retracted position.

The ground prong 4 is formed through insert molding in the channel 21 of the insulating body 2, and includes a hollow prong body 41 and an operating part 42. The prong body 41 is disposed in the channel 21 and is movable in the channel 21 between an extended position (as shown in FIG. 6), in which the prong body 41 extends outwardly of the front end of the insulating body 2 via the aperture 211, and a retracted position (as shown in FIG. 8), in which the prong body 41 is received in the insulating body 2. The degree of extension and retraction of the prong body 41 is limited by a length of the guiding aperture 22. The prong body 41 defines a wire containing space 411 opening toward a rear end of the insulating body 2. The operating part 42 is disposed on a rear end of an outer surface of the prong body 41, extends outwardly of the insulating body 2 through the guiding aperture 22, and is movable in the guiding aperture 22 so as to drive movement of the prong body 41 between the extended position and the retracted position.

The ground wire 5 extends into the wire containing space 411 and includes a connecting end 51 for connecting electrically to an inner surface of the prong body 41, such as by soldering. A length of the ground wire 5 is being stowed in the wire-containing space 411 when the prong body 41 is at the retracted position.

When the prong body 41 is at the extended position, the operating part 42 is at a front end of the guiding aperture 22, and the prong body 41 extends outwardly of the front end of the insulating body 2 via the aperture 211 such that the dual-mode electrical plug 200 can be plugged into an electrical outlet having three insertion apertures (not shown). Preferably, the ground prong 4 further includes an annular protruding part 43 disposed on the outer surface of the prong body 41 adjacent to a rear end thereof, and the insulating body 2 includes an annular first position limiting part 213 disposed on a channel-defining wall 212 of the channel 21 for engaging the protruding part 43 such that the prong body 41 is retained releasably at the extended position. Therefore, when the dual-mode electrical plug 200 is utilized with the outlet having three apertures (not shown), the prong body 41 can be hindered from sliding backward in the channel 21, and the conductive components 3 and the prong body 41 of the dual-mode electrical plug 200 are securely disposed in the three apertures of the outlet (not shown).

Figure 7:
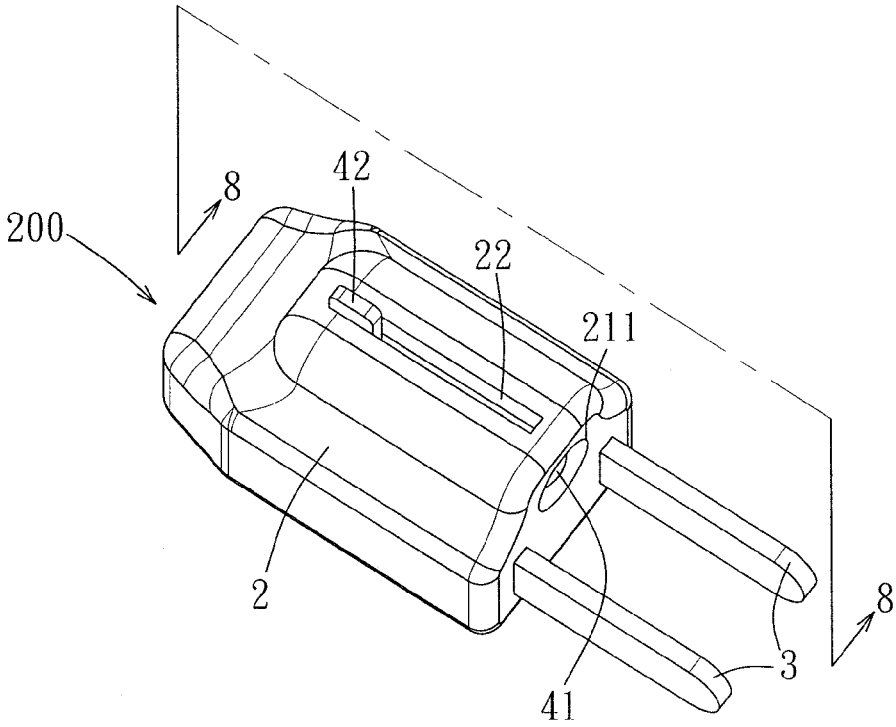
FIG. 7 is a perspective view of the preferred embodiment of the dual-mode electrical plug, illustrating the prong body thereof at a retracted position.

Referring to FIGS. 7 and 8, when it is desired to utilize the dual-mode electrical plug 200 with an electrical outlet having two insertion apertures (not shown), the operating part 42 is used to drive movement of the prong body 41 along a direction (I) so that the protruding part 43 on the outer surface of the prong body 41 disengages the first position limiting part 213, and the prong body 41 is slid backward in the channel 21 so as to be received in the insulating body 2. When the prong body 41 is completely received in the insulating body 2, that is, when the prong body 41 at the retracted position, the dual-mode electrical plug 200 can be plugged into the outlet having two apertures (not shown). Preferably, the insulating body 2 further includes an annular second position limiting part 214 disposed on the channel-defining wall 212 behind the first position limiting part 213 for engaging the protruding part 43 of the prong body 41 such that the prong body 41 is retained releasably at the retracted position. Therefore, when the dual-mode electrical plug 200 is utilized with the outlet having two apertures (not shown), the prong body 41 can be hindered from sliding forward in the channel 21 and extending outwardly of the front end of the insulating body 2.

Moreover, when it is desired to move the prong body 41 from the retracted position to the extended position, the operating part 42 is used to drive movement of the prong body 41 along a direction opposite to the direction (I), so that the protruding part 43 on the outer surface of the prong body 41 disengages the second position limiting part 214 of the insulating body 2, and the prong body 41 is slid forward in the channel 21 so as to engage the first positioning limiting part 213 of the insulating body 2. The prong body 41 is thus releasably retained at the extended position.

Referring to FIGS. 6 and 8, since the ground wire 5 extends into the wire containing space 411 of the prong body 41 and the connecting end 51 of the ground wire 5 is connected to the inner surface of the prong body 41, when the prong body 41 is at the extended position, the ground wire 5 is extended, as shown in FIGS. 5 and 6. On the other hand, when the prong body 41 is at the retracted position, a length of the ground wire 5 is stowed in the wire containing space 411. Therefore, regardless of whether the prong body 41 is at the extended position or at the retracted position, the ground wire 5 maintains contact with the prong body 41 of the ground prong 4 for effective grounding. Moreover, when the prong body 41 is moved from the extended position to the retracted position, the length of the ground wire 5 is smoothly stowed in the wire containing space 411, and thus squeezing of the ground wire 5 by the prong body 41 in the channel 21 is prevented. Preferably, the connecting end 51 of the ground wire 5 is connected to the prong body 41 at a front end location of the inner surface of the prong body 41, so that as the prong body 41 is moved from the extended position to the retracted position, an anterior portion of the ground wire 5 is prevented from bending such that a posterior portion of the ground wire 5 can be received in the wire containing space 411.

In summary, the merit of the dual-mode electrical plug 200 of the present invention resides in the connecting end 51 of the ground wire 5 being connected to the inner surface of the hollow prong body 41 of the ground prong 4, which enables the ground wire 5 to maintain an adequate electrical connection with the ground prong 4 so as to achieve effective grounding regardless of whether the prong body 41 is at the extended position or at the retracted position. Moreover, such connection of the ground wire 5 to the prong body 41 allows a length of the ground wire 5 to be smoothly stowed in the wire containing space 411 of the prong body 41 when the prong body 41 is moved from the extended position to the retracted position. Lastly, the dual-mode electrical plug 200 of the present invention comprises relatively few components as compared with the dual-mode electrical plug of the prior art, and thus can be designed and manufactured at reduced costs.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A dual-mode electrical plug, comprising:

an insulating body formed with a channel that opens at a front end of said insulating body, and with an elongate guiding aperture disposed along a length of said channel and providing access to said channel from outside of said insulating body;

a pair of conductive components disposed on said insulating body and extending outwardly of said front end of said insulating body;

a ground prong including a hollow prong body disposed in said channel and movable in said channel between an extended position, in which said prong body extends outwardly of said front end of said insulating body, and a retracted position, in which said prong body is received in said insulating body, said prong body defining a wire containing space opening toward a rear end of said insulating body, and an operating part disposed on an outer surface of said prong body, extending outwardly of said insulating body through said elongate guiding aperture, and movable in said elongate guiding aperture so as to drive movement of said prong body between the extended position and the retracted position; and a ground wire extending into said wire containing space and including a connecting end for connecting electrically to an inner surface of said prong body, a length of said ground wire being stowed in said wire containing space when said prong body is at the retracted position.

2. The dual-mode electrical plug as claimed in claim 1, wherein said connecting end of said ground wire is connected to said prong body at a front end location of said inner surface of said prong body.

3. The dual-mode electrical plug as claimed in claim 2, wherein said ground prong further includes a protruding part disposed on said outer surface of said prong body, and said insulating body includes a first position limiting part disposed on a channel-defining wall of said channel for engaging said protruding part such that said prong body is retained releasably at the extended position.

4. The dual-mode electrical plug as claimed in claim 3, wherein said insulating body further includes a second position limiting part disposed on said channel-defining wall behind said first limiting part for engaging said protruding part of said prong body such that said prong body is retained releasably at the retracted position.

5. The dual-mode electrical plug as claimed in claim 1, wherein said ground prong further includes a protruding part disposed on said outer surface of said prong body, and said insulating body includes a first position limiting part disposed on a channel-defining wall of said channel for engaging said protruding part such that said prong body is retained releasably at the extended position.

6. The dual-mode electrical plug as claimed in claim 5, wherein said insulating body further includes a second position limiting part disposed on said channel-defining wall behind said first limiting part for engaging said protruding part of said prong body such that said prong body is retained releasably at the retracted position.

* * * * *